United States Patent [19]

Wilden et al.

[11] Patent Number: 4,549,467

[45] Date of Patent: Oct. 29, 1985

[54] ACTUATOR VALVE

[75] Inventors: James K. Wilden, Yucaipa; Alan D. Tuck, Upland, both of Calif.

[73] Assignee: Wilden Pump & Engineering Co., Colton, Calif.

[21] Appl. No.: 519,988

[22] Filed: Aug. 3, 1983

[51] Int. Cl.[4] ..... F01L 25/06

[52] U.S. Cl. ..... 91/307; 91/316; 91/320; 91/329; 137/625.48

[58] Field of Search ..... 137/625.48; 91/281, 91/304, 307, 308, 311, 316, 319, 329, 461, 271

[56] References Cited

U.S. PATENT DOCUMENTS

| | | | |
|---|---|---|---|
| 1,058,804 | 4/1913 | Stevens | 91/307 |
| 2,528,097 | 10/1950 | Weed | 91/304 |
| 2,890,658 | 6/1959 | Hjärpe | 91/319 |
| 4,085,655 | 4/1978 | Olson | 91/307 |
| 4,242,941 | 1/1981 | Wilden et al. | 91/307 |
| 4,339,985 | 7/1982 | Wilden | 91/307 |

*Primary Examiner*—Robert E. Garrett
*Assistant Examiner*—Richard S. Meyer
*Attorney, Agent, or Firm*—Lyon & Lyon

[57] ABSTRACT

An air driven diaphragm pump having an actuator valve for converting a source of compressed air into a reciprocating drive. The actuator valve includes a valve piston for alternately directing air to one side or the other of the pumps, a control rod fixed to the reciprocating elements of the pump and means for shifting the valve piston responsive to the position of the control rod. An axially spaced bifurcated inlet is employed to provide additional energy to the shifting of the valve piston. The valve piston also is arranged to cover vent ports as a mechanism for closing off all compressed air under stalled conditions of the pump.

4 Claims, 5 Drawing Figures

ACTUATOR VALVE

BACKGROUND OF THE INVENTION

The field of the present invention is actuator valves for air driven reciprocating devices, and more specifically wherein the valve includes a pneumatically controlled valve piston.

Actuator valves for reciprocating pneumatically driven devices have been developed which employ a pilot valve or rod responsive to the position of the reciprocating element of the device and a pneumatically controlled valve piston responsive to the position of the pilot rod. The valve piston in turn controls the incoming flow of pressurized air to provide an alternating flow to the reciprocating device. This alternating flow forces the device to stroke back and forth thereby performing work and driving the pilot rod. Such actuator valves thus convert a relatively steady source of pressurized air into an alternating flow without need for any outside timing or control system. The source air pressure alone drives the valve as well as the working device.

One such actuator valve used primarily on air driven diaphragm pumps is disclosed in U.S. Pat. No. 3,071,118, the disclosure of which is incorporated herein by reference. Such air driven diaphragm pumps include diaphragms positioned on either side of an actuator valve in an arrangement similar to that set forth in the present figures, outwardly of the actuator valve and pilot or control rod. Such additional devices and configurations are illustrated in U.S. Pat. No. 4,242,941, No. 4,247,264, No. 4,339,985 and No. Des. 268,413, the disclosures of which are incorporated herein by reference.

The shifting of the valve piston in such devices is understood to occur by the selective venting of one end of the enclosing cylinder in which the piston moves. By selectively venting one end or the other of the cylinder, the energy stored in the form of compressed air at the unvented end of the cylinder acts to drive the piston to the alternate end of its stroke. Under proper conditions, the energy is more than sufficient to insure a complete piston stroke. However, under adverse conditions, such as when foreign material, dirt, grease and the like, is allowed to collect within the cylinder, the damping or resistance to movement of the piston may so increase that the system may require all available potential energy for shifting of the piston. Under such marginal conditions, all possible energy is advantageously applied to insure operation of the actuator valve. One mechanism for providing additional energy for shifting is presently included in the devices of the aforementioned patents. Additional compressed air is supplied through passageways to the expanding chamber at one end of the valve piston. The air is gated into the passageways by the location of the piston. Additional energy, however, could also be useful under severe conditions.

The nature of air driven reciprocating devices such as contemplated for use with the present actuator valve gives them the ability to be used on demand by simply stalling the device rather than by shutting off the source of compressed air. Such a condition might exist with an air driven diaphragm pump where the product to be pumped is maintained under pressure and controlled downstream of the pump by a valve. When the valve is opened, the pump is able to move material through the pump and through the valve. When the valve is closed, the pump will stall when the driving air force equals the compression force on the material being driven. Under such conditions, the pump remains ready to pump further material at any time that the downstream valve is opened.

When an air driven reciprocating device is employed in this manner, the actuator valve will simply remain in the position at the time of stall. Under such conditions virtually no air is used to maintain the pump. However, any passages open to atmosphere and also connected to the inlet pressure will continue to allow air flow therethrough. Therefore, it is advantageous to avoid any point in the pump or actuator valve stroke when such leakage can occur. Any such leakage can be noisy and esthetically unpleasing even if it is not sufficient to amount to a noticeable loss of compressed air.

SUMMARY OF THE INVENTION

The present invention pertains to an actuator valve for a reciprocating air driven device. In a first aspect of the present invention, additional energy is provided to the valve piston during shifting to insure proper actuation of the valve piston. In a second aspect of the present invention, leakage of compressed air under stall conditions is eliminated. Thus, an improved actuator valve is available for air driven reciprocating devices.

In providing additional shifting energy to the valve piston, axially spaced inlet ports selectively bias the valve piston toward completion of its stroke. The inlet ports may be arranged, in a further aspect of the present invention, so that one of the inlet ports is symmetrically positioned over a transverse passage on the valve piston at each end of the valve piston stroke. In an additional feature, the axial spacing of the inlet ports also may be such that a center position in the valve piston stroke is created where incoming compressed air does not pass directly through the transverse passage of the valve piston. To further enhance the biasing of the valve piston, inlet passages to the ports may be inclined. These several features may individually or collectively act to enhance the shifting and proper locating of the piston in the cylinder.

As a mechanism for eliminating leakage flow under stall conditions of the device, the vent passages for the valve piston cylinder are so positioned as to be selectively closed off by the valve piston with the valve piston at an end of its stroke. Naturally, proper location of the valve piston at the ends of its stroke enhances this result. Thus, no matter where the control rod is stalled, the valve piston vent passage which may be vented to atmosphere will be closed to the incoming compressed air.

Accordingly, it is an object of the present invention to provide an improved actuator valve for an air driven reciprocating device. Other and further objects and advantages will appear hereinafter.

DETAILED DESCRIPTION OF THE PREFERRED EMBODIMENT

Figure 1:
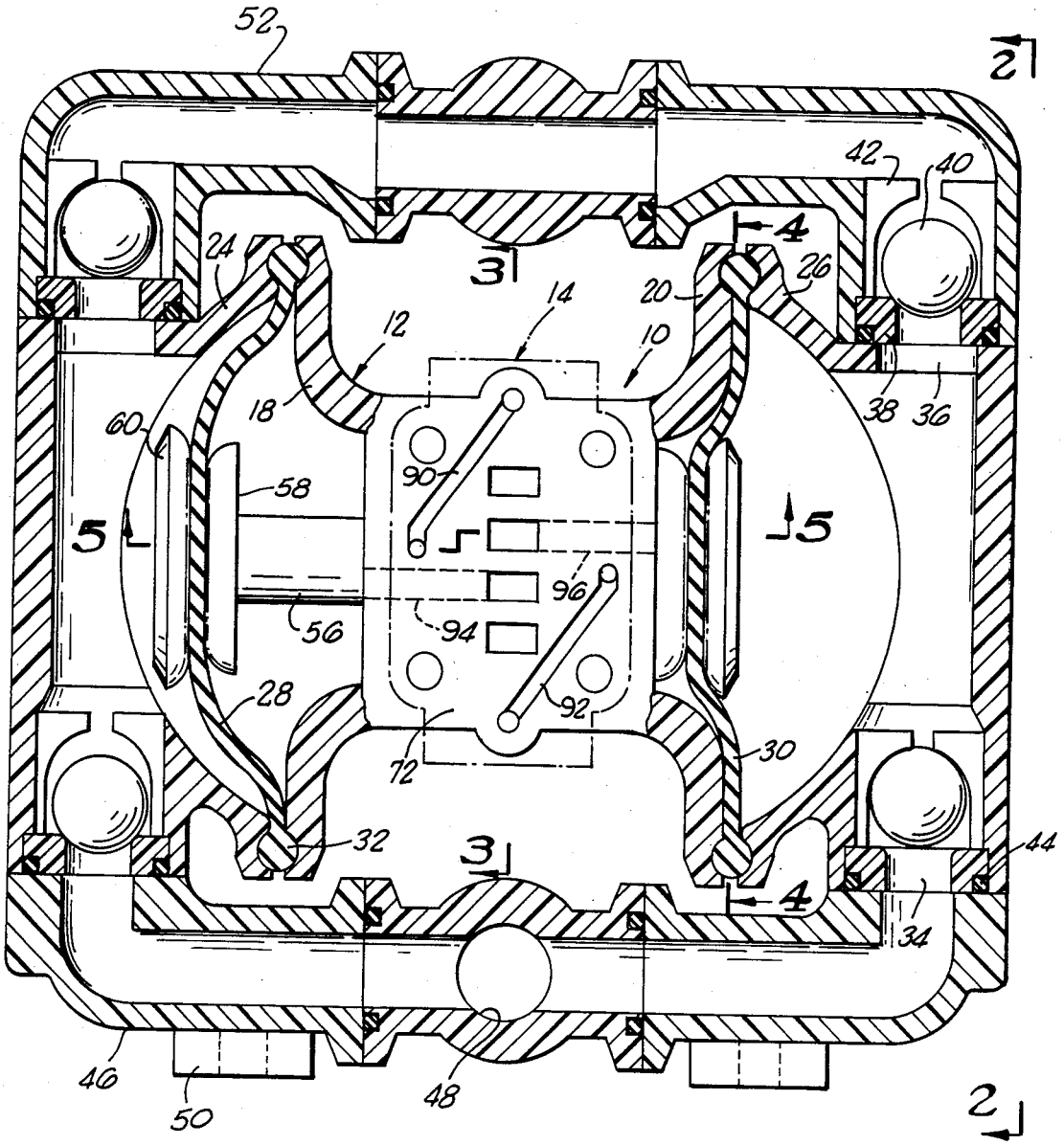
FIG. 1 is a cross-sectional elevation through an are driven reciprocating pump incorporating an actuator valve of the present invention.
Figure 2:
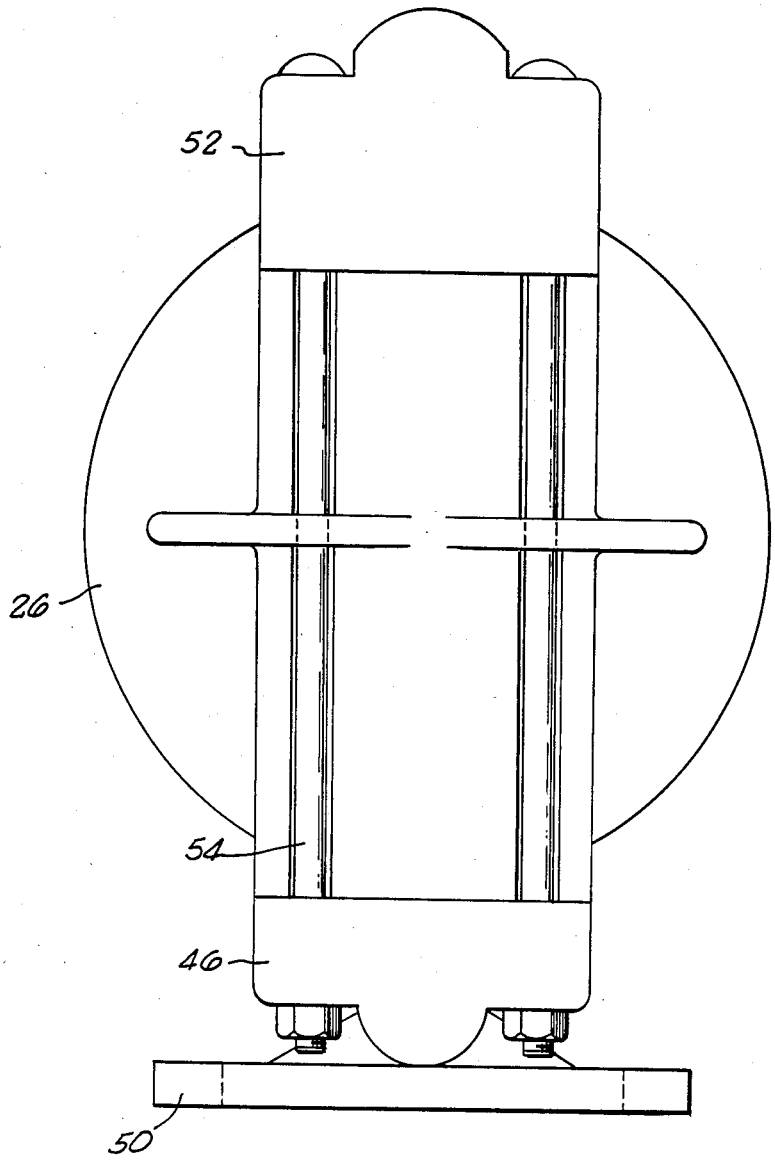
FIG. 2 is an end view taken along line 2—2 of FIG. 1.

Turning in detail to the drawings, FIGS. 1 and 2 illustrate an air driven reciprocating device, namely an air driven diaphragm pump in conjunction with an actuator valve, generally designated 10. As can best be seen in FIG. 3, the actuator valve housing generally includes a main body 12, a cylinder body 14 and a cover 16. The main body 12 is conveniently formed in the present embodiment integrally with the air chamber housings 18 and 20. The main body 12, the cylinder body 14 and the cover 16 are held together by means of fasteners 22 of which there are conveniently four.

Before turning in detail to the actuator valve 10, the air driven diaphragm pump illustrated in FIGS. 1 and 2 include the aforementioned air chamber housings 18 and 20 integrally formed with the main body 12 of the actuator valve 10. Outwardly of the air chamber housings 18 and 20 are pump chamber housings 24 and 26. Between the air chamber housings 18 and 20 and the pump chamber housings 24 and 26 are resilient diaphragms 28 and 30. The diaphragms 28 and 30 include a circular bead 32 positioned within grooves located in both of the air chamber housings 18 and 20 and the pump chamber housings 24 and 26. Clamp bands (not shown) may be positioned around the circular periphery of each pumping mechanism to retain the diaphragms 28 and 30 and to prevent leakage. Each of the pump chamber housings 24 and 26 extends to a pump inlet 34 and pump outlet 36. Check valves, including valve seats 38 and valve balls 40 are arranged at the pump inlet 34 and pump outlets 36 to permit flow in one direction responsive to the pumping action of the diaphragm 28 and 30. Placement ribs 42 retain the balls 40 in position and O-ring seals 44 prevent leakage at the ports.

Associated with the pump inlet 34 is an intake manifold 46. The intake manifold 46 extends from a common inlet 48 to each of the pump inlets 34. As illustrated in the preferred embodiment, the intake manifold 46 is divided into 3 sections which may be conventionally held in place by means of clamp bands (not shown). The intake manifold 46 also includes feet 50 conveniently arranged for support of the pump. Diametrically opposed to the intake manifold 46 is an outlet manifold 52. The outlet manifold 52 is similarly constructed and includes a discharge from the central portion thereof. Additionally, clamp bands may be employed to hold the components in position. As illustrated in FIG. 2, fastening elements 54 extend to hold the manifolds 46 and 52 in position on the pump. Four such fastening elements are conveniently employed.

Extending through the actuator valve 10 is a control rod 56. The control rod 56 extends to two pump piston assemblies at either end thereof. The pump piston assemblies each include an inner plate 58 and an outer plate 60 between which is sandwiched the pump diaphragm 28 or 30. The control rod and pump piston assemblies act to maintain the diaphragms in proper orientation, draw the diaphragm which is on an intake stroke into the air chamber and functionally convey the position of the pump to the actuator valve as will be discussed below.

In this embodiment, the pump is illustrated as principally being of polymeric material with the exception of the O-rings 44 and diaphragms 28 and 30 which are of generally elastomeric material. Additionally, the clamps bands (not shown) and the control rod 56 is more conveniently of metallic material. Additional components in the actuator valve are also of metallic material as will be discussed below.

Looking then to the actuator valve 10, the main body 12 of the actuator valve 10 is integrally formed with the air chamber housings 18 and 20. Thus, opposed walls 62 are defined as both the inner portion of the air chamber housings 18 and 20 and the outer portions of the actuator valve 10. Opposed walls 64 and 66 extend between the opposed walls 62 to form a cavity within the main body 12 of the actuator valve 10. The cavity is closed on one side by the cover 16 which has an outlet 68. The outlet 68 is conveniently threaded to receive a muffler where noise reduction is appropriate or an exhaust pipe where exhausted air must be transported away from the pump.

Located centrally in the main body 12 is a passageway housing 70 extending between the opposed walls 62 for receipt of the control rod 56. The passageway housing 70 is conveniently spaced from the opposed walls 64 and 66 and the cover 16, but is integrally associated with a front wall 72. A control rod sleeve 74, conveniently made of metallic material such as brass extends through the passageway housing 70 to define a passageway 76 for the control rod 56.

A plurality of configurations for both the control rod 56 and the control rod sleeve 74 are available. Reference is made to the aforementioned patents. In the embodiment illustrated, an axial passage 78 is centrally located in the control rod 56. Four sealing O-rings 80 are positioned in annular O-ring grooves 82 to divide the passageway 76 through which the control rod extends into separate zones.

Figure 5:
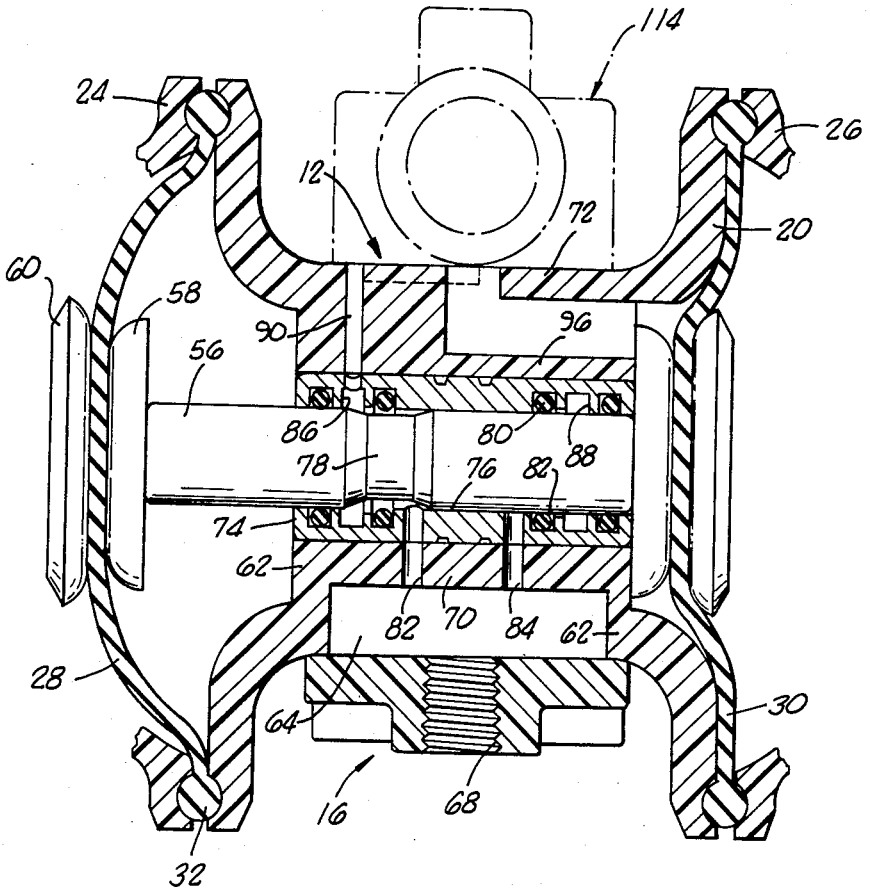
FIG. 5 is a cross-sectional view taken along line 5—5 of FIG. 1.

Control rod vent passages 82 and 84 extend through both the control rod sleeve 74 and the passageway housing 70 such that they are discharged into the cavity or chamber within the main body 12 and then through outlet 68. Outwardly of the control rod vent passages 82 and 84, across sealing O-rings 80, are annular channels 86 and 88. These annular channels are coupled with valve piston vent passages 90 and 92 which extend through the front wall 72 of the main body 12, extend across the surface of the front wall 72 as can best be seen in FIG. 1 and into the cylinder body 14 as can best be seen in FIG. 3. As can be seen in FIG. 5, the valve piston vent passages 90 and 92 may be selectively opened for venting through the control rod vent passages 82 and 84 when the control rod 56 is positioned such that the axial passage 78 spans one or the other of the inner O-rings 80. This occurs at the ends of the stroke of the reciprocating device.

Also extending through the main body 12 of the actuator valve 10 are air chamber ducts 94 and 96. The air chamber ducts 94 and 96 extend through the opposed wall 62 to the air chambers for delivery of compressed working air to the reciprocating device. These ducts extend through the front wall 72 and the cylinder body 14 as can best be seen in FIG. 3.

The cylinder body 14 is securely fastened to the front wall 72 of the main body 14 by the fasteners 22. The cylinder body 14 generally includes a cylinder 98 which extends through the cylinder body 14 for facile machining. End caps 100 and 102 are positioned by means of spring clips 104 in the ends of the cylinder 98. O-rings 106 seal the cylinder 98 at the end caps. An alignment pin 108 is fixed through one of the end caps and extends into the cylinder 98 for alignment with the piston contained therein.

Also defined in the cylinder body 14 is an air inlet 110. The air inlet 110 is threaded for receipt of an appropriate fitting. The air inlet is bifurcated into two inlet passages 112 and 114 which mutually diverge toward two ports 116 and 118. The ports 116 and 118 each includes an eccentrically cut channel which extends part way around the cylinder 98 for greater air distribution into the cylinder 98. Thus, two ports 116 and 118 are axially spaced relative to the cylinder 98 for introduction of compressed air into the actuator valve 10.

Located within the cylinder 98 is a valve piston having a generally cylindrical body and spacers 112 on each end. The valve piston 120 is arranged to slide within the cylinder 98 such that the spacers 122 contact the end caps 100 and 102 at the ends of the stroke. The body of the valve piston is sized such that clearance is provided between the wall of the cylinder 98 and the valve piston 120 to provide means for continuously directing air to the ends of the cylinder. Longitudinal passages 124 extend part way through the piston body to each end thereof. A pin hole 126 is associated with each passage 124 such that a volume of incoming air through air inlet 110 may be directed through the pin hole 126 and the passage 124 to one end or the other of the cylinder 98 when a pin hole is in direct communication with the inlet during a portion of the stroke. Conveniently, the guide pin 108 may be positioned in one of the passages 124 and is sized to allow free flow of air therethrough.

A cavity 128 is formed within the valve piston 120 and has two through ports 130 and 132 connecting the cavity 128 to one side of the cylinder 98. Four ports 134, 136, 138 and 140 are arranged along one wall of the cylinder 98 to cooperate with the through ports 132 and 134. The ports 134 through 140 are arranged such that the through ports 130 and 132 will align with two of the supports with the piston at each end of its stroke. The ports 134 and 140 extend to passages 142 and 144 through the passageway housing 70 of the main body 12 to communicate with the cavity within the main body 12 for exhausting through outlet 68.

A transverse passage 146, which in the present embodiment is a circumferential groove, extends about the center of the valve piston 120. The ports 136 and 138 are aligned such that the transverse passage 146 will communicate with one of the passages at the ends of the stroke of the valve position. Additionally, the transverse passage 146 is aligned with one of the intake ports 116 and 118 at the ends of the valve piston stroke. Thus, communication between the inlet 110 and one or the other of the ports 136 and 138 is achieved at the ends of the valve piston stroke through the transverse passage 146.

The axial spacing of the ports 116 and 118 may be conveniently arranged such that the separation between the ports 116 and 118 is roughly equal to the separation between the ports 136 and 138. This aligns the ports on either end of the transverse passage 146 for enhanced flow therethrough. Also, the inlet ports 116 and 118 may be spaced such that both cannot be open to the transverse passage 146 at the same time. Extraneous airflow in the transverse passage 146 is not likely to have any effect on the shifting action with such spacing.

Major flow through the transverse passage 146 is initiated when the valve piston 120 opens one of the ports 116 and 118 as well as the corresponding one of the ports 136 and 138 where atmospheric pressure exists. When communication is initiated between a high pressure port and a low pressure port, the incoming air is directed at the piston 120 with velocity and against the side walls of the transverse port 136 to provide additional energy for shifting of the valve piston 120. The flow of air through the transverse passage 146 is understood to have the effect of centering the passage 146 relative to the port, either 116 or 118, this being at one end or the other of the valve piston stroke. The mutual divergence of the inlet passages 112 and 114 also may give an axial component of flow velocity to further induce movement of the valve piston 120 to the end of its stroke.

The valve piston vent passages 90 and 92 are shown to intersect the cylinder 98 at locations adjacent to the ends of the cylinder 98 as defined by the end caps 100 and 102. However, these valve piston vent passages 90 and 92 are spaced from the ends of the cylinder 98 enough so that the valve piston body will selectively cover over and close the nearest valve piston vent passage at the ends of the stroke. The vent passages 90 and 92 are also diametrically opposed to the inlet 110. Because of pressures on the valve piston 120, the valve piston is forced away from the inlet 110 and against the side of the cylinder 98 where the valve piston vent passages 90 and 92 intersect the cylinder 98. Because of the energy directed to the valve piston 120 during shifting and the clearance around the valve piston 120, the valve piston 120 is capable of extending in its stroke until the spacers 122 contact one or the other of the end caps 100 and 102. Care should be taken to insure that sufficient space remains at each end of the cylinder 98 such that momentary pressure buildup will not result in the remaining space acting as a pneumatic spring, once the valve piston vent passage, 90 or 92, is covered. As there is no unbalanced pressure which would tend to force the piston away from the end position, the valve piston remains in position covering one or the other of the valve piston vent passages 90 and 92 until the valve piston 120 is again caused to shift.

Figure 3:
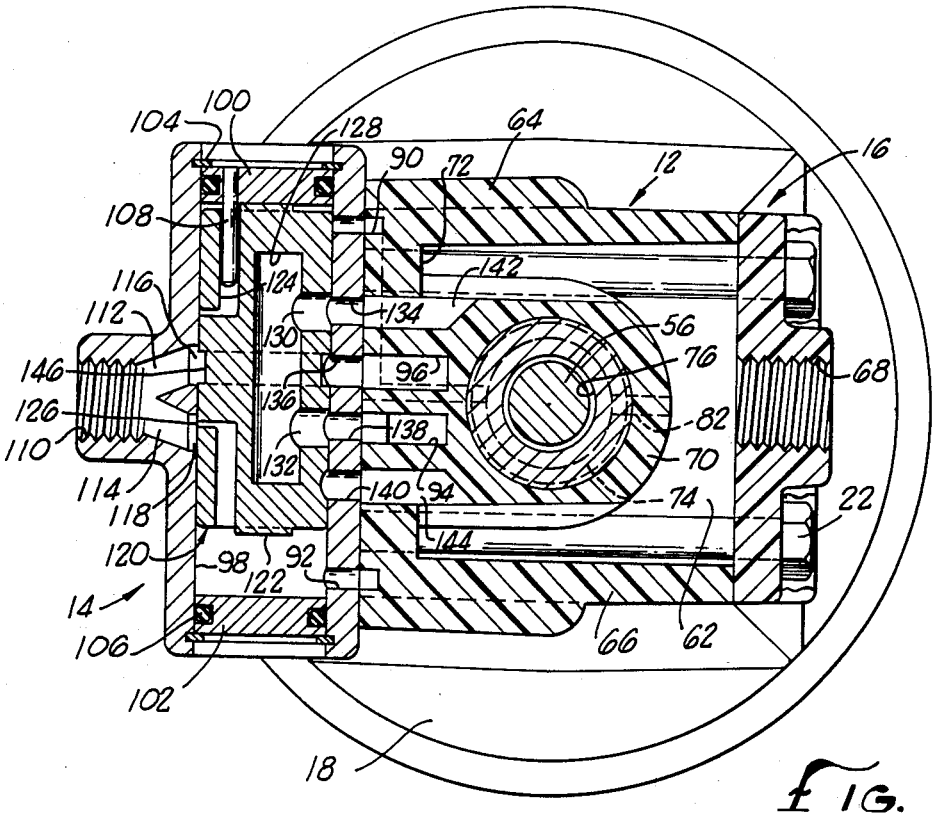
FIG. 3 is a cross-sectional elevation taken along line 3—3 of FIG. 1.
Figure 4:
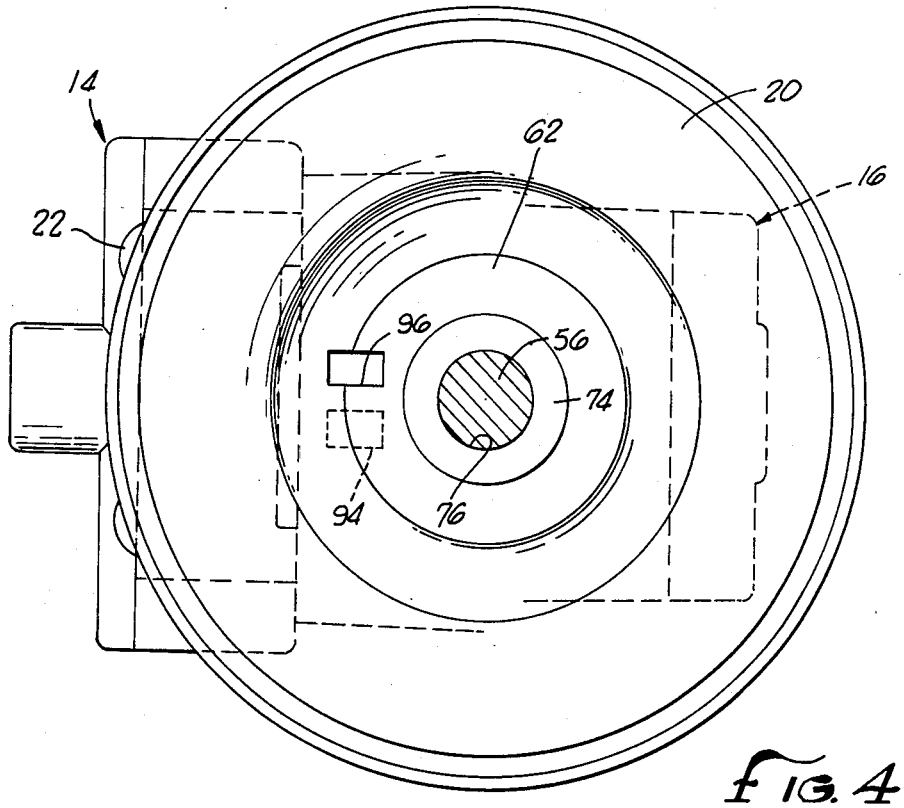
FIG. 4 is a cross-sectional elevation taken along line 4—4 of FIG. 1.

Having described the elements and features of the actuator valve, the operation of the system is here described. Compressed air is caused to enter the inlet 110 with the valve piston 120 at one end or the other of its stroke. Looking to the position as seen in FIG. 3, compressed air proceeds through inlet passage 112, port 116 and transverse passage 146 to port 136. Thus, compressed air is supplied to the air chamber duct 96 where it proceeds to the air chamber on the right of the device as illustrated in FIG. 1. This causes the diaphragms 28 and 30, the control rod 56 and the pump piston assemblies to move to the right as viewed in FIG. 1 in a pump stroke. Having moved through a pump stroke, the axial passage 78 of the control rod 56 meets and traverses the sealing O-ring between the control rod vent passage 84 and the channel 88 connected with the valve piston vent passage 92. The vent passage 92, the valve piston vent passage 92, the axial passage 78 on the control rod 56 and the control rod vent passage 84 thus provide a means for venting the end of the cylinder 98 adjacent to the vent passage 92.

The piston 120 includes a clearance with the cylinder 98 such that compressed air has accumulated around the piston 120 with both vent passages 90 and 92 in the closed position. With the venting, as described above, of the valve piston vent passage 92, the compressed air around the spacer 122 at the opposite end of the valve piston 120 causes the valve piston 120 to shift toward the other end of the cylinder 98. Once the piston 120 has moved a certain distance, the pin hole 126, which is in communication with the closed end of the valve piston 120, is exposed to the inlet 110 at the port 116. At this time, additional compressed air is directed to the trailing end of the valve piston 120 to add further energy to the shift. As the shift of the valve piston 120 continues, the transverse passage 146 approaches the port 138 in the side of the cylinder 98 and also the intake port 118. As these ports come into communication with the transverse passage 146, additional air is directed at the transverse passage 146 which is allowed to then pass through the port 138. With the orientation of the inlet passage 114, the air is believed to have an axial component aiding in the movement of the valve piston in its stroke and a centering effect to move and retain the transverse passage 146 in line with one of the inlet ports 116 and 118. In this way, energy is supplied to the valve piston 120 for its stroke to the opposite end of the cylinder 98.

The valve piston 120 is also maintained throughout its operation abutting against the side of the cylinder 98 diametrically opposed to the inlet 110. This results from the fact that at least the ports 134 and 140 are always open to atmosphere while the inlet 110 is open to compressed air. Thus, there is a pressure differential across the valve piston 120 holding it against the side of the cylinder 98 with the ports 134, 136, 138, 140 and the passages 90 and 92.

Once the shift of the piston 120 has occurred, air flows through the inlet passage 114, the transverse passage 146 and the port 138 into the air chamber duct 94. This compressed air then pushes the diaphragm to the left to initiate a return stroke. As may be recognized, the through ports 130 and 132 cooperate to vent, through the air chamber ducts 94 and 96, the side of the pump which is not being supplied with compressed air. In this way, the pump is able to reciprocate responsive to the positioning of the valve piston 120 which in turn is responsive to the location of the control rod 56. As the control rod 56 moves with the reciprocation of the pump, a continuous control loop is defined to convert a constant compressed air input into reciprocating motion. With the valve piston 120 at either end of its stroke, the valve piston vent passages 90 and 92 are alternately closed to the cylinder 98. If the pump is stalled with the control rod 56 in a position to vent one end or the other of the cylinder 98, the piston 120 will have shifted to cover the corresponding valve piston vent passage to substantially close off all flow of air from the entire device. This naturally conserves on compressed air and the energy to create same as well as removing objectionable noise under the stalled condition.

Thus, an improved actuator valve for an air driven reciprocating device is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An actuator valve for an air driven reciprocating device, in combination comprising a valve piston having a single transverse passage;

a control rod fixed to reciprocate with the air driven reciprocating device;

a housing having a cylinder closed at each end and enclosing said valve piston, a passageway through which said control rod extends, an air inlet to said cylinder spaced from the ends of said cylinder, valve piston vent passages extending from said cylinder to said passageway, and control rod vent passage means for venting said passageway extending from said passageway to atmosphere, said valve piston cooperating with said housing to include means for directing incoming air to the ends of said valve piston and means for selectively directing incoming air to and exhausting outgoing air from the air driven reciprocating device, said air inlet including two ports axially spaced at said cylinder, said ports selectively aligning with said transverse passage when said piston is at the ends of said cylinder and said control rod including at least one axial passage in said control rod to cooperate with said valve piston vent passages and said control rod vent passage means.

2. An actuator valve for an air driven reciprocating device, in combination comprising a valve piston having a single transverse passage;

a control rod fixed to reciprocate with the air driven reciprocating device;

a housing having a cylinder closed at each end and enclosing said valve piston, passageway through which said control rod extends, an air inlet to said cylinder spaced from the ends of said cylinder, valve piston vent passages extending from said cylinder to said passageway, and control rod vent passage means for venting said passageway extending from said passageway to atmosphere, said valve piston cooperating with said housing to include means for directing incoming air to the ends of said valve piston and means for selectively directing incoming air to and exhausting outgoing air from the air driven reciprocating device, said air inlet including two ports axially spaced at said cylinder and two inlet passages extending to said two ports, said inlet passages being inclined to mutually diverge toward said ports, said ports selectively aligning with said transverse passage when said piston is at the ends of said cylinder and said control rod including at least one axial passage in said control rod to cooperate with said valve piston vent passages and said control rod vent passage means.

3. An actuator valve for an air driven reciprocating device, in combination comprising a valve piston having a single transverse passage, said transverse passage being a circumferential groove about said valve piston;

a control rod fixed to reciprocate with the air driven reciprocating device;

a housing having a cylinder closed at each end and enclosing said valve piston, a passageway through which said control rod extends, an air inlet to said cylinder spaced from the ends of said cylinder, valve piston vent passages extending from said cylinder to said passageway, and control rod vent passage means for venting said passageway entending from said passageway to atmosphere, said valve piston cooperating with said housing to include means for directing incoming air to the ends of said valve piston and means for selectively directing incoming air to and exhausting outgoing air from the air driven reciprocating device, said air inlet including two ports axially spaced at said cylinder and two inlet passages extending to said two ports, said inlet passages being inclined to mutually diverge toward said ports, said ports selectively aligning with said transverse passage when said piston is at the ends of said cylinder and said control rod including at least one axial passage in said control rod to cooperate with said valve piston vent passages and said control rod vent passage means.

4. An actuator valve for an air driven reciprocating device, in combination comprising a valve piston having a single transverse passage;

a control rod fixed to reciprocate with the air driven reciprocating device;

a housing having a cylinder closed at each end and enclosing said valve piston, a passageway through which said control rod extends, an air inlet to said cylinder spaced from the ends of said cylinder, valve piston vent passages extending from said cylinder to said passageway, and control rod vent passage means for venting said passageway extending from said passageway to atmosphere, said valve piston cooperating with said housing to include means for directing incoming air to the ends of said valve piston and means for selectively directing incoming air to and exhausting outgoing air from the air driven reciprocating device, said air inlet including two ports axially spaced at said cylinder, said ports selectively aligning with said transverse passage when said piston is at the ends of said cylinder and said control rod including at least one axial passage in said control rod to cooperate with said valve piston vent passages and said control rod vent passage means, said axially spaced ports being separated by at least the width of said transverse passage.

* * * * *